US011338569B2

(12) United States Patent
Jeretzky et al.

(10) Patent No.: US 11,338,569 B2
(45) Date of Patent: May 24, 2022

(54) SCREEN PRINTING DEVICE HAVING A SCREEN PRINTING STENCIL

(71) Applicant: KOENIG & BAUER AG, Würzburg (DE)

(72) Inventors: Gerald Jeretzky, Hüllhorst (DE); Ralf-Rudi Redeker, Bünde (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/255,460

(22) PCT Filed: May 10, 2019

(86) PCT No.: PCT/EP2019/062045
§ 371 (c)(1),
(2) Date: Dec. 23, 2020

(87) PCT Pub. No.: WO2020/074136
PCT Pub. Date: Apr. 16, 2020

(65) Prior Publication Data

US 2021/0252846 A1 Aug. 19, 2021

(30) Foreign Application Priority Data

Oct. 8, 2018 (DE) ..... 10 2018 124 754.0

(51) Int. Cl.
*B41F 15/08* (2006.01)
*B41F 15/46* (2006.01)
*B41F 15/30* (2006.01)

(52) U.S. Cl.
CPC ..... *B41F 15/46* (2013.01); *B41F 15/0818* (2013.01); *B41F 15/0895* (2013.01); *B41F 15/30* (2013.01)

(58) Field of Classification Search
CPC .. B41F 15/0818; B41F 15/0895; B41F 15/30; B41F 15/46
See application file for complete search history.

(56) References Cited

U.S. PATENT DOCUMENTS 5,436,028 A * 7/1995 Becher ..... B41F 15/0818 427/98.4
5,711,217 A 1/1998 Boring et al.
(Continued)

FOREIGN PATENT DOCUMENTS

DE 2020424 A1 11/1971
DE 4431596 C1 10/1995
(Continued)

OTHER PUBLICATIONS

International Search Report of PCT/EP2019/062045 dated Aug. 22, 2019.

*Primary Examiner* — Jill E Culler
(74) *Attorney, Agent, or Firm* — Mattingly & Malur, PC

(57) ABSTRACT

A screen printing device has a screen printing stencil. At least two doctor blade systems, each acting on the screen printing stencil are provided. The at least two doctor blade systems are arranged to each apply printing ink to an object to be printed in the same printing process. Each of the doctor blade systems has at least one doctor blade. Each of the doctor blades is arranged to sweep over the screen printing stencil. Each of the doctor blade systems is individually controlled by a control unit. The at least one doctor blade of each of the doctor blade systems is moved by a robot. At least respective two-dimensional motion paths of the doctor blades of each doctor blade system are each freely programmed and are established by control of the robot.

15 Claims, 2 Drawing Sheets

(56) References Cited

U.S. PATENT DOCUMENTS

| | | | | |
|---|---|---|---|---|
| 5,985,376 | A | 11/1999 | Kamen | |
| 6,395,335 | B2 * | 5/2002 | Onishi | B41F 15/42 101/129 |
| 6,494,132 | B1 | 12/2002 | Sano et al. | |
| 6,935,232 | B2 * | 8/2005 | Onishi | B41F 15/46 101/126 |
| 8,640,615 | B2 * | 2/2014 | Miyahara | B41F 15/12 101/123 |
| 8,833,253 | B2 | 9/2014 | Okawa et al. | |
| 8,985,014 | B2 * | 3/2015 | Willshere | B41F 15/44 101/123 |
| 9,352,409 | B2 * | 5/2016 | Kuroda | B23K 3/0638 |
| 2008/0093322 | A1 * | 4/2008 | Ehrenleitner | B66F 7/0633 212/274 |
| 2008/0163770 | A1 | 7/2008 | Bui et al. | |
| 2009/0101027 | A1 | 4/2009 | Goetz et al. | |
| 2010/0263471 | A1 * | 10/2010 | Weber | B25J 17/0266 74/490.06 |
| 2014/0053743 | A1 | 2/2014 | Okawa et al. | |
| 2018/0186147 | A1 | 7/2018 | Winterhalter et al. | |

FOREIGN PATENT DOCUMENTS

| | | | | |
|---|---|---|---|---|
| DE | 102005006732 | A1 | 8/2006 | |
| DE | 102015212515 | | 1/2017 | |
| DE | 102017214073 | A1 | 3/2018 | |
| EP | 112012005138 | T5 | 10/2014 | |
| EP | 2995453 | A1 | 3/2016 | |
| EP | 3666524 | A1 * | 6/2020 | H05K 3/1233 |
| WO | 2008083257 | A2 | 7/2008 | |

* cited by examiner

SCREEN PRINTING DEVICE HAVING A SCREEN PRINTING STENCIL

CROSS-REFERENCE TO RELATED APPLICATIONS

This application is the U.S. National Phase, under 35 U.S.C. § 371, of PCT/EP2019/062045, filed May 10, 2019; published as WO 2020/074136 A1 on Apr. 16, 2020, and claiming priority to DE 10 2018 124 754.0, filed Oct. 8, 2018, the disclosures of which are expressly incorporated herein in their entireties by reference.

FIELD OF THE INVENTION

The present invention relates to a screen printing device having a screen printing stencil. At least two squeegee systems, each acting on the screen printing stencil, are provided. Each of the at least two squeegee systems is positioned to apply printing ink, in the same printing process, to an object to be printed. Each of these squeegee systems has at least one squeegee. Each of these squeegees is positioned to sweep over the screen printing stencil.

BACKGROUND OF THE INVENTION

From DE 20 20 424 A, a screen printing device having at least two squeegee systems that participate alternatingly in the printing process is known, wherein the squeegee systems are circulated by means of chains, and the respective squeegees are deployed alternatingly and are returned to their home point once the printing process is complete. The squeegees proceed staggered in relation to one another, for example, by a constant phase angle of, e.g. 180°. The squeegees can be guided by two endless chains, which are arranged side by side and parallel to one another.

U.S. Pat. No. 5,985,376 A describes a screen printing device having a screen printing stencil, in which at least two squeegee systems, each acting on said screen printing stencil, are provided, wherein the at least two squeegee systems are each positioned to apply printing ink in the same printing process to an object to be printed, wherein each of these squeegee systems has at least one squeegee, wherein each of these squeegees is positioned so as to sweep over the screen printing stencil, wherein each of these squeegee systems is controlled individually by a control unit.

From DE 10 2015 212 515 A1, a screen printing device comprising a printing screen, a printing squeegee, and a support for a printing material to be printed, wherein at least one articulated arm robot is provided for moving the printing squeegee and/or the support relative to the printing screen.

From DE 10 2005 006 732 A1, a screen printing device for printing curved surfaces is known, having a printing squeegee, a printing screen held in a screen frame, and means for moving the printing squeegee, wherein the screen frame is flexible at least in sections on at least one side. DE 10 2005 006 732 A1 contains a reference to a printing squeegee attached to a squeegee holder, the squeegee holder being guided by guide arms, wherein said guide arms may be arms of a freeform robot.

DE 44 31 596 C1 relates to a device for printing the surface of objects, said device having a printing device and two mutually independent compound slides, which are arranged opposite one another with respect to a central plane and are movable parallel to one another, each having holders for receiving and handling the objects during the printing process, which protrude into the central plane lying between the planes of motion of the two compound slides and brush past one and the same motion field in said plane, and which can be moved with the aid of the compound slides in such a way that said holders pick up the objects to be printed directly from a feed conveyor, feed them to the printing device, and after printing deposit them onto a delivery conveyor. Said device can be configured as a screen printing press.

DE 11 2012 005 138 T5 relates to a mask holder for holding a mask, which is brought into contact with a substrate in a screen printing press, the mask holder comprising: a right and a left side support part that support both the right and the left sides of the mask, which has been inserted horizontally from the front; an operating element capable of movement operation in a forward/backward direction with respect to the right and the left side support part; a rod element, which is provided such that it extends in the forward/backward direction along a lateral section of the right and the left side support parts so that a front end of the rod element is connected to the operating element; a back edge stopper, which is connected to a back end of the rod element and is moved in the forward/backward direction by the rod element by the movement operation in the forward/backward direction with respect to the right and the left side support parts by the operating element, and which is fixed to the right and the left side support parts by the fixing operation of the rod element to the right and the left side support parts by the operating element, and is abutted against a rear edge of the mask, the right and left sides of which are supported by the right and left side support parts, respectively; and a front edge stopper, which is abutted against a front edge of the mask, the right and left sides of which are supported by the right and left side support parts, respectively.

WO 2008/083257 A2 relates to an apparatus for printing designs or images on a small or constrained area of a substrate. The apparatus comprises a screen printing assembly, a print head, and a guide assembly. A squeegee and a flood bar of the print head are placed at a predetermined position.

SUMMARY OF THE INVENTION

The object of the present invention is to create a screen printing device having a screen printing stencil, in which the use of at least two squeegee systems, each acting on said screen printing stencil, is or at least can be flexibly adapted to the object to be printed.

The object is attained according to the invention by the provision that each of these at least two squeegee systems is controlled individually by a control unit. The at least one squeegee of each of these at least two squeegee systems is moved by a robot. A respective at least two-dimensional motion path of the respective squeegee of each squeegee system is freely programmed and is established by the control of the relevant robot.

The advantages to be achieved with the present invention are, in particular, that the movements of the respective squeegees can be guided individually per article. Other specific movements that take place, e.g. immediately following the actual printing process are also possible through corresponding programming of the robots. This results in mutually independent individual motion sequences for each of the squeegees involved in the printing process, without a movement path rigidly predefined by a guidance system and also without a positive mechanical coupling, for example, with the simultaneous use of multiple squeegees. Especially for the printing of mass-produced articles, it is also advantageous that the time between two printing processes can be reduced because waiting times can be shortened or eliminated, for example.

BRIEF DESCRIPTION OF THE DRAWINGS

Exemplary embodiments of the present invention are depicted in the set of drawings and will be described in greater detail below.

The drawings show.

DESCRIPTION OF THE PREFERRED EMBODIMENTS

Figure 1:
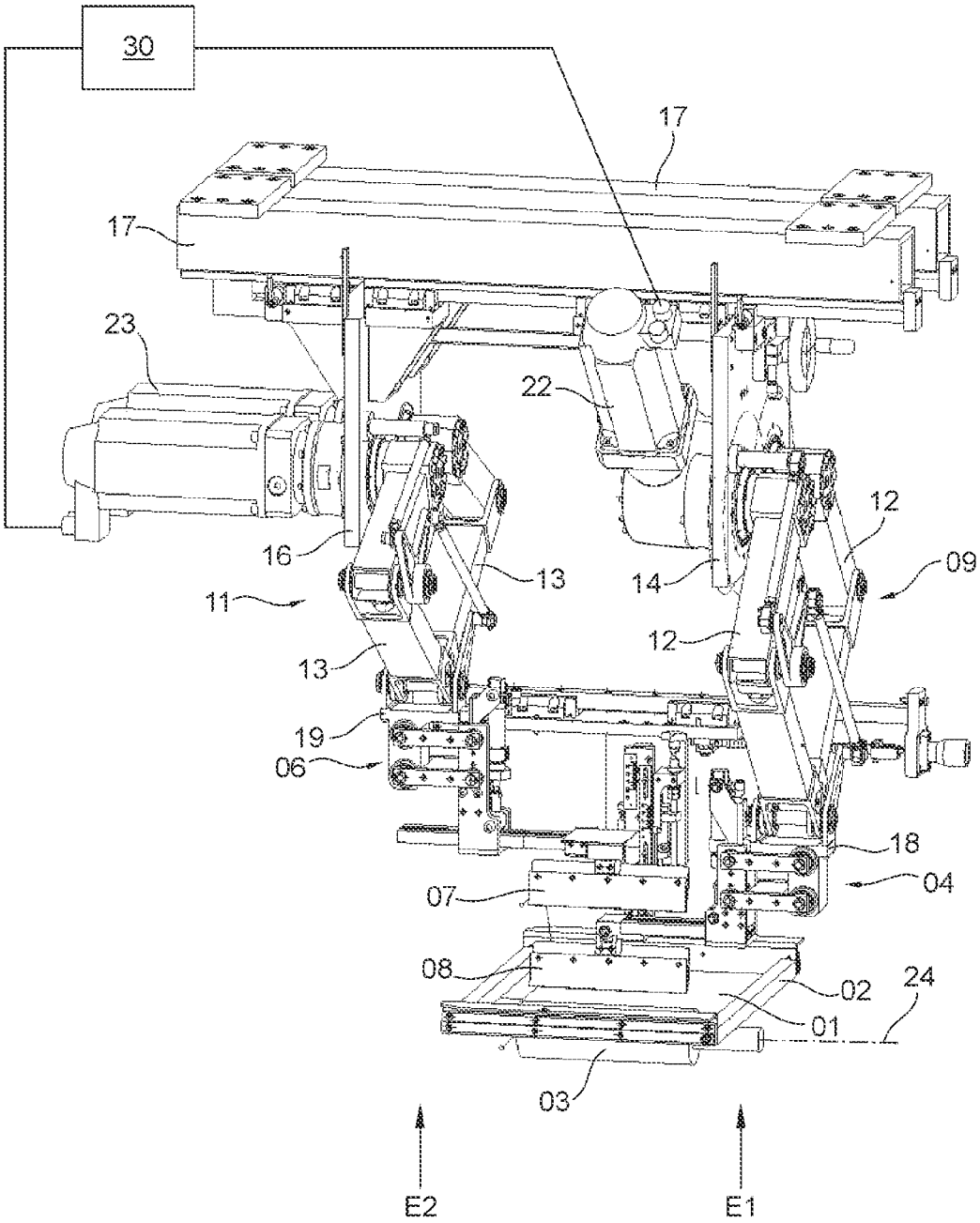
FIG. 1 a first embodiment of a screen printing device.
Figure 2:
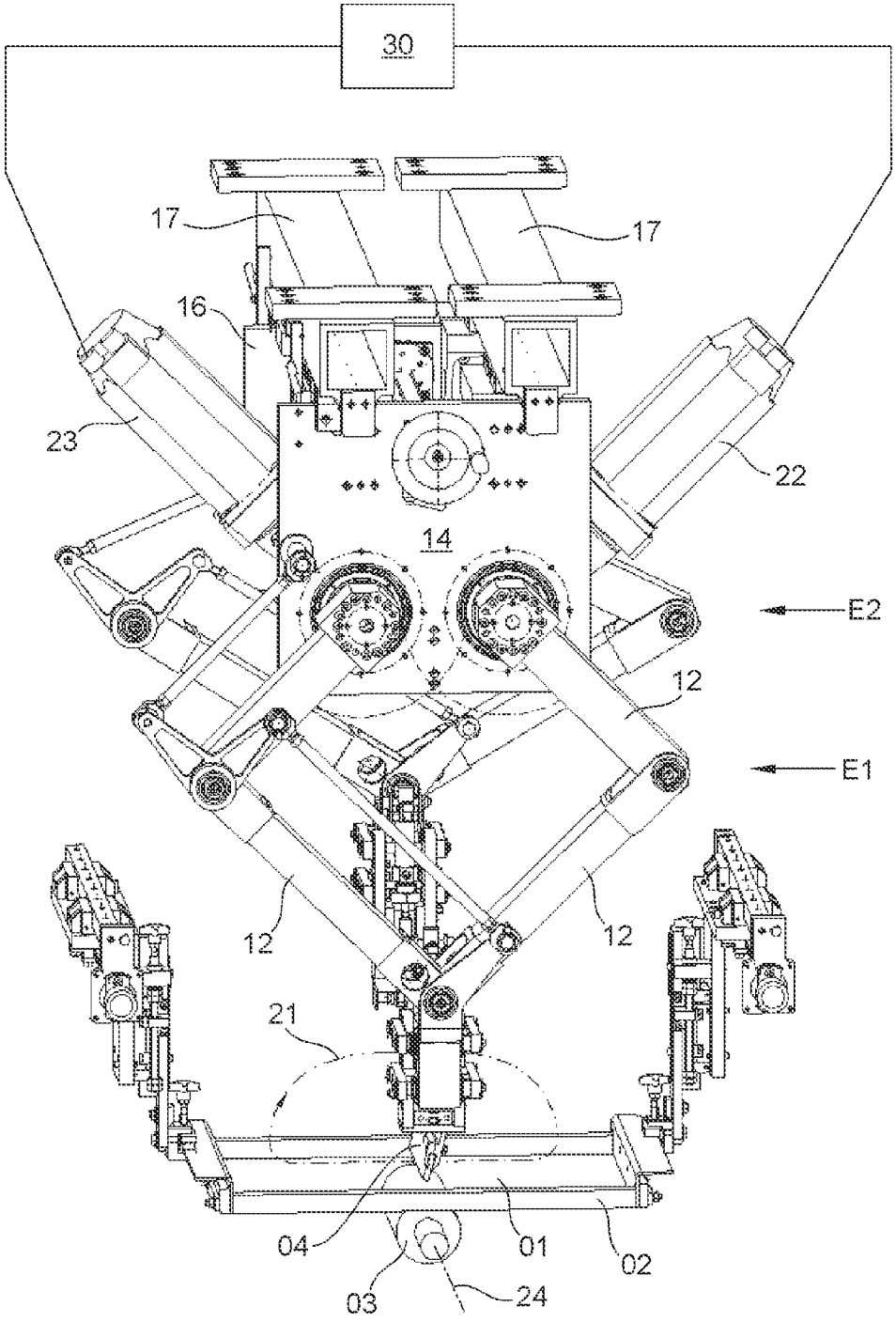
FIG. 2 a second embodiment of the screen printing device.

FIGS. 1 and 2 show two embodiments of the proposed screen printing device by way of example. In both embodiments, a screen printing stencil 01, in particular a flat printing screen stencil, is enclosed in a stationary, for example, preferably rectangular, in particular rigid frame 02 and is arranged, e.g. in a linear printing press or in a rotary table printing press. A linear printing press that includes a screen printing device is known, e.g., from DE 10 2017 214 073 A1. A rotary table printing press having a screen printing device is known, e.g., from EP 2 995 453 A1. Both types of printing presses are used for printing objects 03, each of which is configured, e.g., as a round object 03 or as a hollow object 03, in particular as a rotationally symmetrical hollow object 03. Typically, each object 03 to be printed is held in a transport system and is guided through the printing press by means of the transport system, with the object 03 to be printed being positioned at least briefly during the printing process by the relevant transport system at the screen printing stencil 01, i.e. positioned there, preferably beneath the screen printing stencil 01. During the printing process, the relevant object 03, which is rotated, e.g. about its longitudinal axis 24, during the printing process, is printed, e.g. on its lateral surface by means of the screen printing device in that the object 03 to be printed comes into rolling contact with the screen printing stencil 01. A large number of objects 03 are preferably printed in succession by the screen printing device, e.g. in a linear printing press or in a rotary table printing press between 300 and 600 of these objects 03 are printed per minute by the relevant screen printing device. The screen printing device thus operates in an industrial printing process for printing mass-produced articles, in particular round objects 03 or hollow objects 03, e.g. the respective lateral surface of bottles made of glass or of plastic, preferably bottles used for beverages or cosmetics.

For applying printing ink in the same printing process to the object 03 to be printed, multiple, e.g. two, squeegee systems 04; 06, each controlled separately, i.e. individually, by a preferably digital control unit 30 are provided, each of these squeegee systems 04; 06 having at least one squeegee 07; 08, and each of said squeegees 07; 08 being positioned so as to sweep over the screen printing stencil 01. Thus, each of these squeegees 07; 08 executes a relative movement with respect to the preferably stationary screen printing stencil 01. The at least one squeegee 07; 08 of each of the squeegee systems 04; 06 is guided in each case within a plane E1; E2, said planes E1; E2 being arranged spaced apart from one another and parallel to one another. In particular, the at least one squeegee 07; 08 of each of the squeegee systems 04; 06 is guided in each case within a vertical plane E1; E2. With respect to the longitudinal axis 24 of the objects 03 to be printed, the mutually parallel planes E1; E2 are arranged in particular in a row or one behind the other along said longitudinal axis 24, so that different squeegee systems 04; 06 can each also be used to print, e.g. different areas of the object 03 to be printed.

Each respective squeegee 07; 08 of each of these squeegee systems 04; 06 is guided or moved by a robot 09; 11, with a motion path 21 (indicated in FIG. 2) of each relevant squeegee 07; 08 of each squeegee system 04; 06 being freely programmed or at least freely programmable, meaning that a respective at least two-dimensional motion path 21 of each relevant squeegee 07; 08 of each squeegee system 04; 06 is established by the control of the relevant robot 09; 11. The respective motion path 21 of the squeegee 07; 08 of the relevant squeegee system 04; 06 is preferably programmed, i.e. specified, based on the contours of the object 03 to be printed with this screen printing device, so as to deploy the respective squeegee 07; 08 on the screen printing stencil 01 selectively, i.e. only at selected positions of a print image to be applied, particularly if the contour profile of the object 03 to be printed is uneven or discontinuous, and to cause said squeegee to sweep over the screen printing stencil 01 in accordance with the input programming specification through a corresponding actuation of the robots 09; 11 carried out by the control unit 30.

In the preferred embodiment, each of the robots 09; 11 is configured as a parallel arm robot with rod kinematics or as what is known as a delta robot 09; 11 or a robot with delta kinematics. Delta robots 09; 11 have multiple arms 12; 13, preferably at least three, connected by means of articulated joints, in particular universal joints, to a common base 14; 16, with the shape of said arms 12; 13 being reminiscent of the Greek letter delta. The axes of a spider-like delta robot 09; 11 interact to form a closed kinematic chain. The base 14; 16 of each respective delta robot 09; 11 is arranged, in particular fixedly, above the moving parts of the relevant delta robot 09; 11, i.e. on a mounting frame 17 of a linear printing press or a rotary table printing press, for example. The multiple, preferably at least three arms 12; 13, in particular articulated arms 12; 13, each extend down, i.e. downward, from the base 14; 16. The lower ends of these arms 12; 13 are in turn connected, e.g. to a triangular or rectangular platform 18; 19, known as the gripper platform, which has a smaller surface area than the respective base 14; 16. The respective squeegee 07; 08 of each of the squeegee systems 04; 06 acting on the screen printing stencil 01 is connected to the respective platform 18; 19, each platform being moved by the relevant arms 12; 13, and is therefore guided in its respective motion behavior by the respective movement of the relevant platform 18; 19.

In the aforementioned type of robot 09; 11, the drive system is as follows: If at least one motor 22; 23, electric in particular, which is controlled by the control unit 30 and is located in the base 14; 16, drives the respective axis of at least one of the articulated arms 12; 13, the platform 18; 19 disposed therebeneath moves along X and/or Y and/or Z travel paths, i.e. along one-dimensional or two-dimensional or three-dimensional travel paths, visually along the sides of a parallelogram. Depending on the number of degrees of freedom, delta robots 09; 11 may also execute rotational movements. The articulated arms 12; 13 of robots 09; 11 of this construction can be driven, i.e. moved, by a linear drive and/or by a rotary drive. Since the respective drive or motor 22; 23 for the articulated arms 12; 13 is located in the relevant base 14; 16 in each case, the articulated arms 12; 13 themselves of the proposed robots 09; 11 do not have a drive or motor 22; 23 that is controlled by the control unit 30. As a result, the mass and/or inertia of the articulated arms 12; 13 is relatively low.

It is proposed that the squeegee drive of the screen printing device be formed by means of robots 09; 11, preferably by means of delta robots 09; 11. This screen printing device is used in particular for the printing of objects 03, each of which is configured as a round object 03 or as a hollow object 03. In a highly advantageous embodiment, a linear printing press or a rotary table printing press is configured as having at least one screen printing device that has the features described above.

A squeegee drive implemented by means of controlled robots 09; 11 is highly precise and allows individual adjustment of a squeegee pressure and/or a squeegee position and/or a squeegee speed. Advantageously, an object 03 to be printed is first measured, at least in terms of its contours, after which the respective motion path 21 of the relevant squeegee 07; 08 of each squeegee system 04; 06 is programmed and then executed based upon the results of the measurements. In that case, it may be provided for the relevant squeegees 07; 08 of different squeegee systems 04; 06 that are involved in the same printing process to be deployed alternatingly or at staggered intervals.

A robot 09; 11 configured as a parallel arm robot with rod kinematics or as a delta robot has the advantage over known articulated arm robots, particularly those in industrial use, of actually enabling the cycle speeds that are required for printing mass-produced articles in the first place, these cycle speeds typically being in the range of up to three cycles per second. Articulated arm systems of the type used in an industrial robot are not equipped for this and are therefore unsuitable for the use intended according to the invention. The extensive spatial flexibility of handling offered by articulated arm systems is not an advantage for the present intended use in a screen printing device, particularly in a screen printing device arranged in a linear printing press or rotary table printing press; on the contrary, it results in substantial limitations in terms of dynamics due to the masses to be moved in articulated arm systems. The situation is entirely different for a parallel arm robot with rod kinematics or for a delta robot. Because the respective drives of a parallel arm robot with rod kinematics or a delta robot are located outside of the arm kinematics, these parallel kinematics have only small moving masses and can therefore achieve the very high speed and dynamics that are required.

Furthermore, the free programmability of a robot according to the invention, as compared with the squeegee systems known from the prior art as described in the introductory section, solves a problem that lies in the high material load on the screen mesh during the printing process. Conventional systems, such as the chain system described in DE 20 20 424 A, for example, are characterized in that the same point load is always applied to the screen mesh at the site where the squeegee is deployed. After a certain period of time, the screen typically tears at that site, resulting in an interruption of the production process being carried out with the screen printing device. In contrast, a squeegee system guided by a robot enables the squeegee deployment point to be varied geometrically within a zone defined with respect to the screen printing stencil, while the functioning of the squeegee system otherwise remains the same (e.g. with respect to maintenance of register), thereby enabling a more uniform mesh load and a longer screen service life.

While preferred embodiments of a screen printing device having a screen printing stencil, in accordance with the present invention, have been set forth fully and completely hereinabove, it will be apparent to one of skill in the art, that various changes could be made thereto, without departing from the true spirit and scope of the present invention, which is accordingly to be limited only by the appended claims.

The invention claimed is:

1. A screen printing device comprising:

a single screen printing stencil;

at least first and second separate squeegee systems, each of the at least first and second separate squeegee systems acting independently on the single screen printing stencil, each of the at least first and second separate squeegee systems being positioned to apply printing ink, in a single printing process, to an object to be printed, each of the at least first and second separate squeegee systems each having at least one squeegee, wherein each of the at least one squeegee in each of the at least first and second separate squeegee systems is positioned to sweep independently over the single screen printing stencil;

a control unit for individually, separately controlling each of the at least first and second separate squeegee systems independently of each other;

wherein the at least one squeegee of each of the at least first and second separate squeegee systems is moved by a respective separate one of a first and second robot; wherein a respective at least two-dimensional, mutually individual motion sequence of the respective at least one squeegee of each of the at least first and second separate squeegee systems, by mutually independent individual motion sequence of each of the respective ones of the first and second robots, is individually programmed and is separately controlled by the control unit; and wherein each of respective ones of the first and second separately controlled robots is configured as a multiple parallel arm robot having delta kinematics.

2. The screen printing device according to claim 1, wherein the respective motion path of the respective at least one squeegee of each of the at least first and second squeegee system is specified based on contours of the object to be printed by the screen printing device.

3. The screen printing device according to claim 1, wherein the single screen printing stencil is one of configured as a flat screen printing stencil and is enclosed in a stationary frame.

4. The screen printing device according to claim 1, wherein the multiple arms of each of the respective first and second robots are each connected by articulated joints to a respective one of a first and a second base, wherein the respective base of each of the respective first and second robots is arranged above moving parts of each of the first and second robots and wherein the multiple arms of each of the first and second robots each extend downward from the respective one of the first and second bases, wherein lower ends of the multiple arms of each of the first and second robots are connected to a gripper platform for each of the first and second robots, which gripper platform is smaller than the respective one of the first and second bases, wherein the at least one squeegee of each of the at least first and second squeegee systems acting on the single screen printing stencil is connected to the respective gripper platform that is moved by the relevant multiple arms of each of the first and second robots, wherein, as a drive for a motion to be executed by at least one of the multiple arms of each of the first and second of the respective robot, at least one motor, which is controlled by the control unit, is arranged in the respective one of the first and second bases.

5. The screen printing device according to claim 1, wherein each at least one squeegee of each of the at least first and second squeegee systems is guided within a separate one of first and second planes, wherein the first and second planes are arranged being spaced apart from one another and parallel to one another.

6. The screen printing device according to claim 5, wherein, with respect to a longitudinal axis of the object to be printed, the mutually parallel ones of the separate first and second planes are arranged one behind the other.

7. The screen printing device according to claim 1, wherein one of a squeegee pressure and a squeegee position and a squeegee speed are adjusted individually in each of the at least first and second squeegee systems.

8. A method for using a screen printing device according to claim 1, including using the screen printing device for printing at least one object, with each object being configured as one of a hollow object and as a round object.

9. The method according to claim 8, further including measuring at least the contours of the at least one object to be printed, specifying a respective motion path of the respective at least one squeegee of each of the at least first and second squeegee systems, based on the measuring results, using a program, and controlling the relevant robot using the control unit in accordance with the program.

10. The method according to claim 8, wherein, if the contours of the at least one object to be printed are one of uneven and discontinuous, deploying the respective at least one squeegee of each of the at least first and second squeegee systems on the single screen printing stencil only at selected positions of a print image that is to be applied to the at least one object to be printed, and being positioned to sweep over the single screen printing stencil.

11. The method according to claim 8, further including deploying each of the respective at least one squeegee of each of the at least first and second squeegee systems in the printing process one of alternatingly and at staggered intervals.

12. One of a linear printing press and a rotary table printing press, each having at least one screen printing device according to claim 1, and each having a transport system, wherein the object to be printed is held in the transport system and is guided by the transport system through the printing press, wherein the object to be printed is positioned by the transport system, during the printing process, at the single screen printing stencil of the screen printing device located in the printing press.

13. The one of the linear printing press and the rotary table printing press according to claim 12, wherein, during a printing process, the object to be printed is positioned by the transport system beneath the single screen printing stencil of the screen printing device arranged in the printing press.

14. The one of the linear printing press and the rotary table printing press according to claim 12, wherein a respective one of first and second bases of each of the respective first and second robots is arranged fixedly on a mounting frame of the one of the linear printing press and the rotary table printing press.

15. A method for using one of the linear printing press and the rotary table printing press according to claim 12 one of wherein the screen printing device, which is arranged in the one of the linear printing press and in the rotary table printing press, is used in an industrial printing process for printing mass-produced articles and wherein, in the one of the linear printing press and in the rotary table printing press, between 300 and 600 objects per minute are printed in succession by the screen printing device.

* * * * *